US005597021A

United States Patent [19]

Crossdale et al.

[11] Patent Number: 5,597,021

[45] Date of Patent: Jan. 28, 1997

[54] DISPENSING CLOSURE FOR LIQUID CONTAINERS

[75] Inventors: Garry W. Crossdale, Ripley; Michael Veveris, Sinfin, both of Great Britain

[73] Assignee: Unilever N.V., Rotterdam, Netherlands

[21] Appl. No.: 491,840

[22] PCT Filed: Dec. 21, 1993

[86] PCT No.: PCT/CA93/00550

§ 371 Date: Aug. 29, 1995

§ 102(e) Date: Aug. 29, 1995

[87] PCT Pub. No.: WO94/14697

PCT Pub. Date: Jul. 7, 1994

[30] Foreign Application Priority Data

Dec. 12, 1992 [GB] United Kingdom ..... 9226624

[51] Int. Cl.[6] ..... B65B 1/04; B65B 3/04

[52] U.S. Cl. ..... 141/346; 141/367; 141/384; 222/484; 137/625.19; 137/590

[58] Field of Search ..... 141/346, 29, 291–293, 141/323, 348, 367, 382, 383, 384; 222/484; 137/212, 625.19, 590, 588

[56] References Cited

U.S. PATENT DOCUMENTS

| | | | |
|---|---|---|---|
| 965,704 | 7/1910 | Goldberg | 141/293 |
| 3,384,276 | 5/1968 | Henningfield | 222/484 |
| 5,042,698 | 8/1991 | Fessell | 222/484 |

FOREIGN PATENT DOCUMENTS

| | | |
|---|---|---|
| 0268948 | 6/1988 | European Pat. Off. . |
| 0345070 | 12/1989 | European Pat. Off. . |
| 4202592 | 8/1993 | Germany . |
| 1079494 | 8/1967 | United Kingdom . |
| 9208548 | 5/1992 | WIPO . |

OTHER PUBLICATIONS

2244 Research Disclosure (1990) Mar., No. 311, New York, U.S. XP 000104553 Chemical Drun Connection pp. 278–280, Disclosed by John R. Weaver, II.

*Primary Examiner*—Henry J. Recla
*Assistant Examiner*—Steven O. Douglas
*Attorney, Agent, or Firm*—Wood, Herron & Evans, P.L.L.

[57] ABSTRACT

A close for allowing the emptying of the contents of a container comprises: a hollow closure member (1) for a container, the closure member having an outlet (2) for the contents; a rotatable plug (3) mounted within the closure member, the plug having a first through-passage (4) for the contents with an inlet (32) and an outlet (34), the plug being rotatable between a first closed position in which the inlet (32) of the through-passage is out of register with the closure member outlet (2) and a second position in which the inlet is in register with the closure member outlet to permit the contents to pass into the passageway; a connector (5) for transfer of the contents out of the container, the connector having means (7) to engage the exposed portion of the plug, and the connector (5) when engaged with the plug (3) can be turned to rotate the plug to the open position, or to the closed position.

15 Claims, 4 Drawing Sheets

DISPENSING CLOSURE FOR LIQUID CONTAINERS

FIELD OF THE INVENTION

The present invention relates to a connection DEVICE, for example a device allowing the safe and secure connection of containers of a liquid product to a suction tube by which liquid product is transferred to other use containers or use equipment.

BACKGROUND OF THE INVENTION

This type of device is used in industrial facilities, such as hotels, hospitals, commercial kitchens and the like where different cleaning products are filled into individual containers for use by cleaning staff.

Conventionally, a suction tube is simply pushed into each open top of separate upright containers, such as drums of products. The suction tube is connected to the suction side of a dispensing device, such as a pump or the like. The suction developed in the tube draws liquid out of the drum because the drum in an appropriate manner communicates with atmosphere to always maintain atmospheric pressure in the drum. When the drum is empty, the suction tube is pulled out and placed into a new, full drum. There is a real risk of a tube being fitted into the wrong drum if the user is at all careless. This would cause contamination of the product in the drum and cause secondary containers to be refilled with the wrong product. During the changeover there is also a risk of the user touching the wetted tube as it is moved from one drum to another and thereby exposing the user to potentially hazardous chemicals.

It is also known to provide product in bulk in boxes with collapsible bags therein, the bags having an outlet valve to which a connector on the end of a tube is attached. The attachment of the connector automatically pushes open the valve. The connector is turned to lock it onto the valve and the valve and connector can be provided with matching lugs and recesses to prevent connection of the wrong tube. The boxes and tubes can also be color-coded.

British Patent No. 1054052 describes yet another alternative system which includes a tap for a container. The outlet from the container is connected via an aperture to a cylindrical sleeve in which a hollow spigot is rotatably mounted. The hollow spigot is also provided with an aperture. The spigot has a handle by means of which it can be turned to bring the spigot aperture in and out of line with the outlet aperture in the sleeve.

An object of an aspect of the invention is to provide an improved closure for discharging the contents of a container in a reliable manner.

SUMMARY OF THE INVENTION

Accordingly, the invention provides a closure for allowing the emptying of the contents of a container, comprising a hollow closure member for the container, the closure member having an inlet for the contents;

a rotatable plug mounted within the closure member, the plug having a through-passage for the contents and being movable between a first position in which one end of the through-passage does not register with the inlet and a second position in which it does;

a connector for transfer of the contents out of the container, the connector having means to engage the plug of the closure member and a through-passage for registration with the through-passage of the plug; whereby the connector can be engaged and disengaged with the plug and can turn the plug to allow selective opening and closing of the inlet of the closure member.

According to another aspect of the invention, a closure for allowing the emptying of the contents of a container comprises:

a hollow closure member for a container, the closure member having an outlet for the contents;

a rotatable plug mounted within the closure member, the plug having a first through-passage for the contents with an inlet and an outlet, the plug being rotatable between a first closed position in which the inlet of the through-passage is out of register with the closure member outlet and a second open position in which the inlet is in register with the closure member outlet to permit the contents to pass into the passageway;

means for retaining the closure member in a container, the retaining means exposing an outer portion of the rotatable plug, the exposed portion having the outlet of the first through-passage therein;

a connector for transfer of the contents out of the container, the connector having means to engage the exposed portion of the plug, the connector having a second through-passage with an inlet in communication with the outlet of the first through-passage;

the connector when engaged with the plug can be turned to rotate the plug to the open position, or to the closed position.

Advantageously, the plug may have a through-passage for air and the closure member have an inlet for air with which the air through-passage can register on rotation of the plug.

BRIEF DESCRIPTION OF THE DRAWINGS

Preferred embodiments of the invention are described with reference to the accompanying drawings, wherein.

DETAILED DESCRIPTION OF THE PREFERRED EMBODIMENTS

Figure 1:
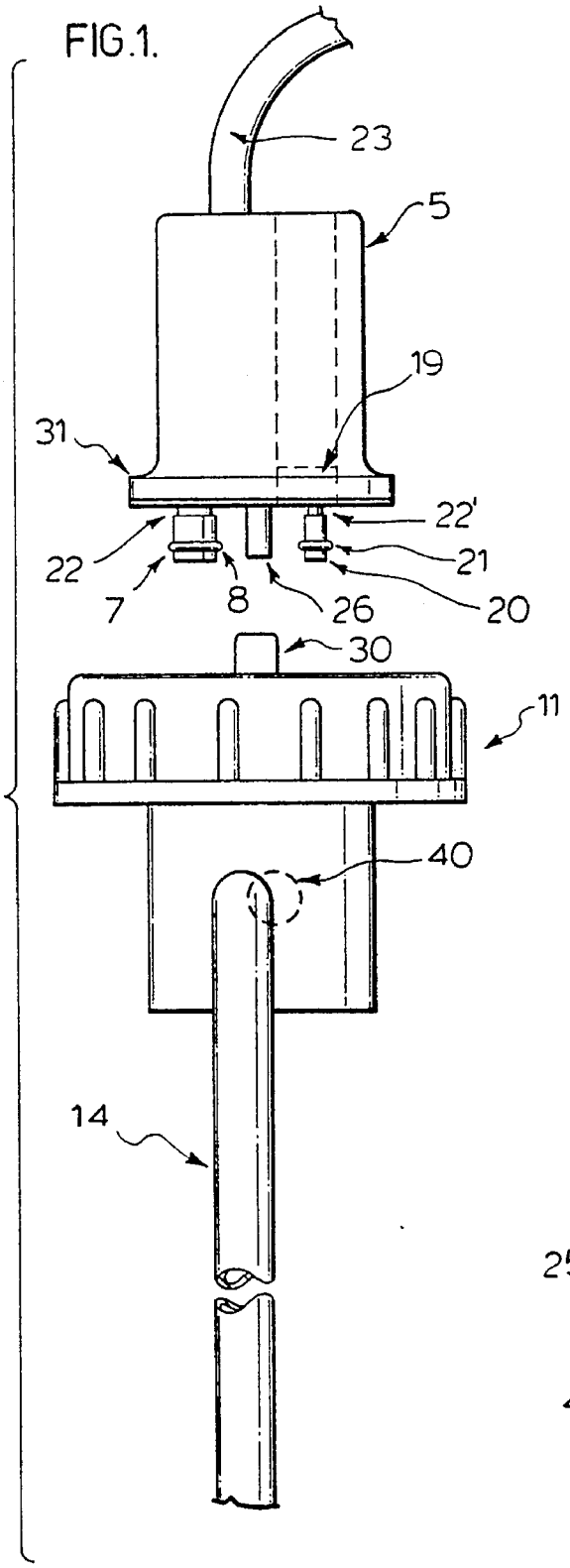
FIG. 1 is an elevational view of a closure according to the invention.

The closure shown in FIGS. 1, 2, 3, 4 and 5 comprises a hollow closure member 1 which has an outlet 2. The closure member is fitted on the neck of a container of, for example, liquid detergent.

A rotatable plug 3 is mounted within the closure member 1, the dimensions of the plug 3 and member 1 being such that a tight fit between the two is created. The plug 3 has a through-passage 4 and can be rotated between a first closed position in which the inlet end 32 of the passage 4 does not register with the outlet 2 of the closure member 1 and a second position in which it does.

To transfer the product out of the drum and into smaller containers, for example, a connector 5 is used, the connector 5 having a through-passage 6 which has an inlet 33 registered with an outlet 34 of passage 4 of the plug 3. The connector 5 may engage the plug 3 by means, for example, of product spigot 7 which fits into passage 4. The spigot 7 engages in passage 4 in a sealing manner by means of, for example, a conventional O-ring 8.

The engagement of the connector to the plug allows the connector to turn the plug between its open and closed positions, thus opening and closing the closure member.

The closure member 1 is formed of a generally cylindrical hollow body 10 fitted centrally on the inside of a cap 11 which is secured onto the neck 12 of a container opening. The closure member has adjacent its open end 35, a circular peripheral flange 36. The flange 36 is secured against the drum 12 by the cap 11. The flange may be sandwiched between the cap 11 and a seal 13. A polyethylene foam gasket ring seal 13 can be used to create an airtight connection between the cap 11 and the container neck 12. The cap may be threaded onto the neck 12 by threads 37 in order to compress the gasket and form a tight seal. It is appreciated that other devices, such as clamps, may be used to secure the cap on the container.

The outlet 2 of the closure member connects to a pick-up tube 14 which extends into the body of the drum and down to the bottom of the drum to ensure emptying of the contents of the drum.

The plug 3 is also substantially cylindrical in shape to match the dimensions of the closure member. The passage 4 has a step 15 or socket along its length to limit the extent to which the product spigot 7 can be inserted and to receive the enlarged spigot diameter compared to the diameter of the passage 4. The plug 3 also has a second through-passage 16 with an inlet 38 in enlarged area 17 or socket and an outlet 39. The outlet 39 registers with the inlet 40 in the closure member 1. This passage allows air into the drum as the product is emptied out of the drum. The passage 16 has a step 17 to receive the enlarged diameter of the spigot 20 compared to the passage 16.

The connector 5 has a through-passage 19 for allowing air in, and this passage 19 ends in an air spigot 20 which is inserted in the socket portion on air passage 16 of the plug 3. The spigot 20 has a seal, for example a conventional O-ring 21, which may be like that of the product spigot 7.

Both spigots 7 and 20 are formed with an undercut 22, 22' so that the diameter of a circle defined by the undercuts 22 and 22' is slightly smaller than the diameter defined by the radius of circular opening 24 of the cap 11. With the cap in place, the opening 24 exposes the outer position 42 of the plug. Such exposure provides coupling of the connector with the plug.

The end of product passage 6 of connector 5 is fitted to a suction tube 23 to allow the contents of the drum to be sucked out in a conventional manner and filled into other containers.

Figure 2:
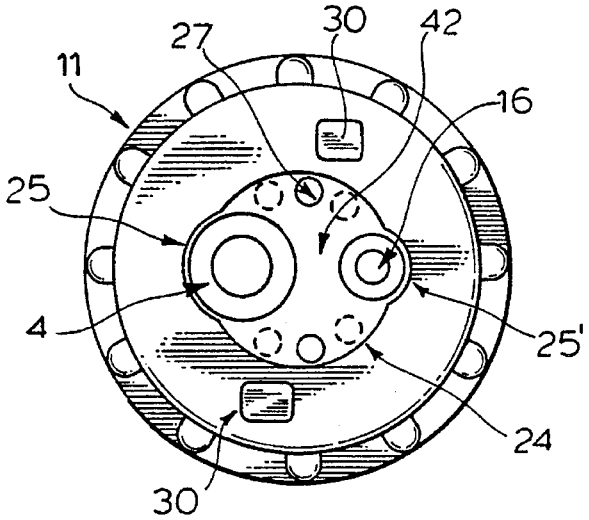
FIG. 2 is a plan view of the closure member and plug of FIG. 1.
Figure 3:
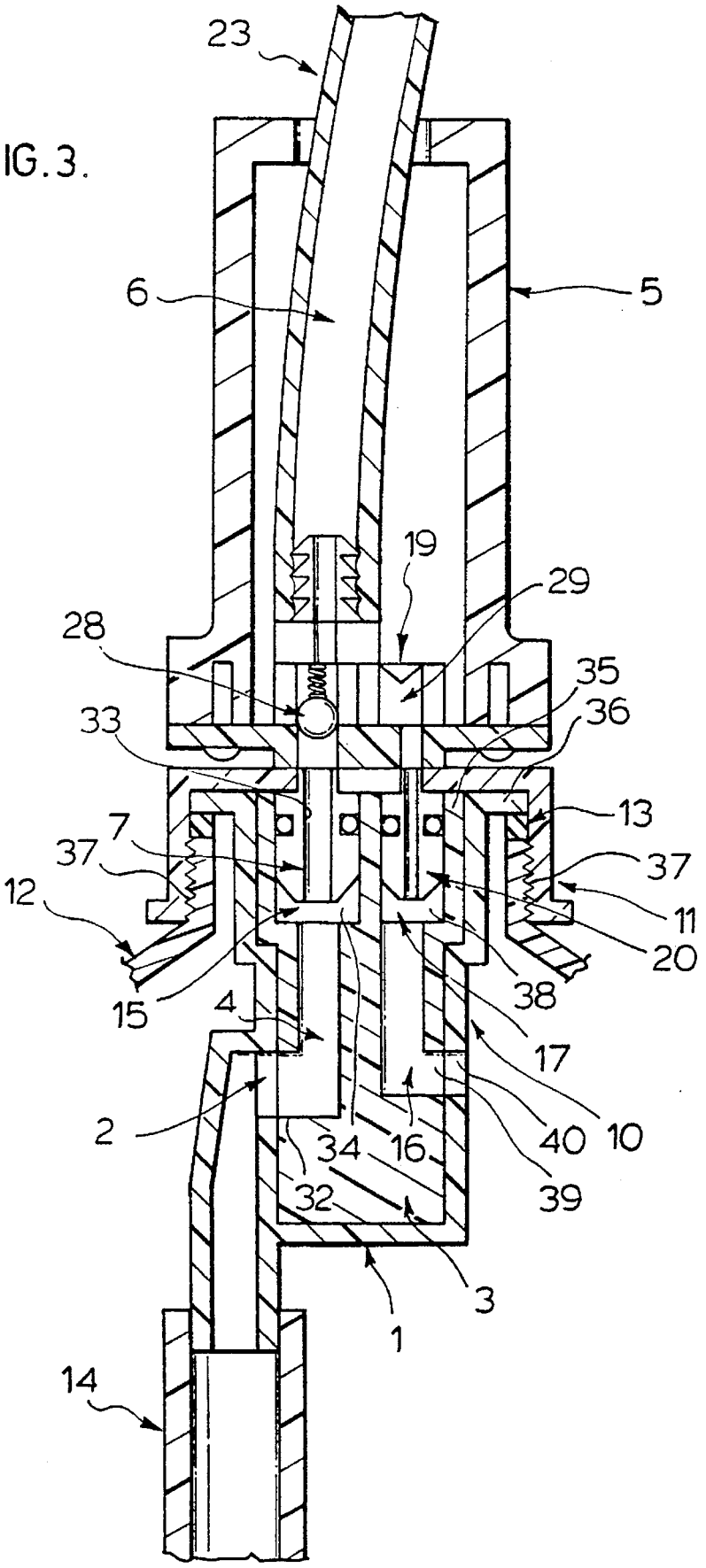
FIG. 3 is a schematic sectional view of the closure of FIG. 1.
Figure 4:
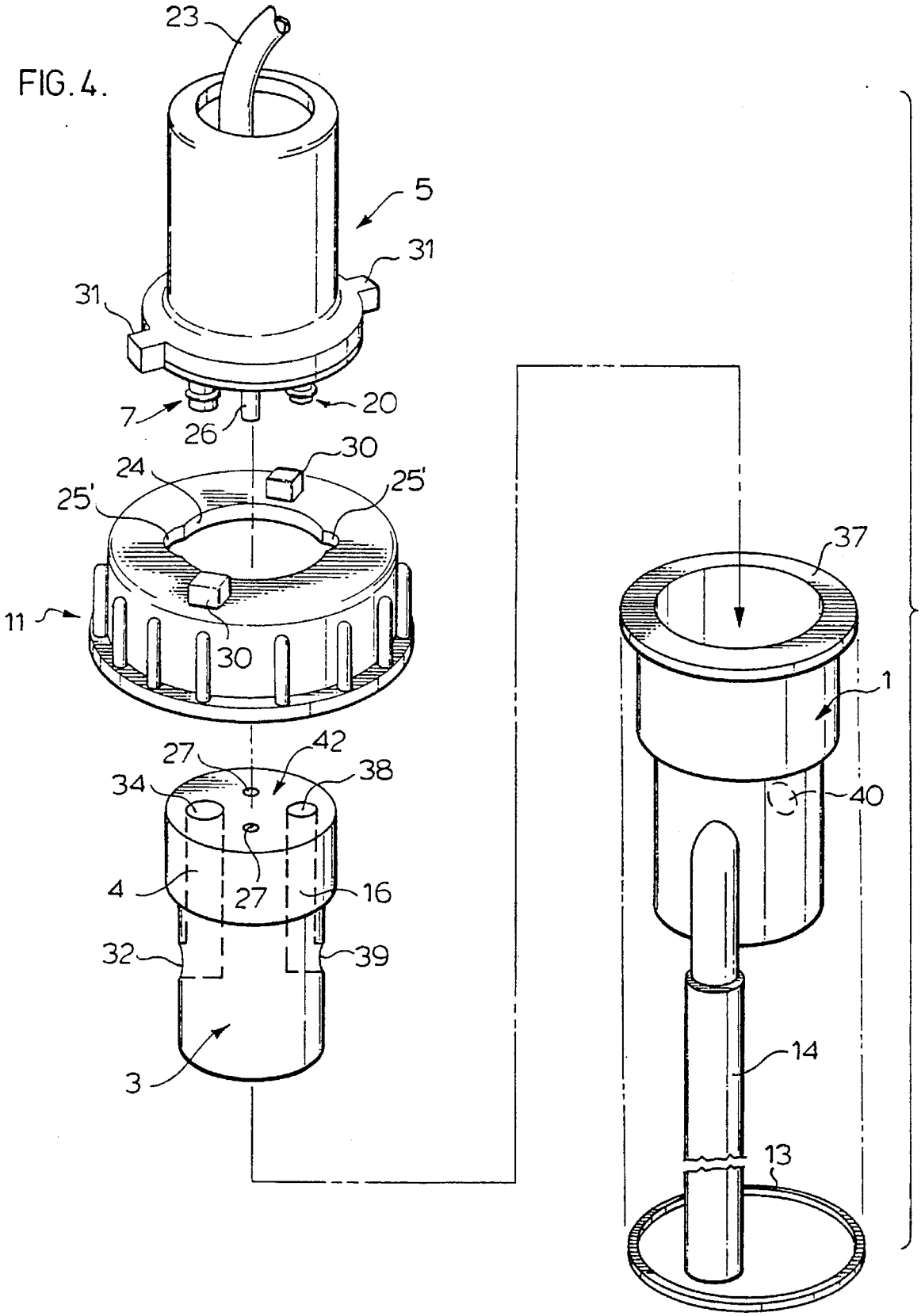
FIG. 4 is an exploded perspective view of the closure of FIG. 1.
Figure 5:
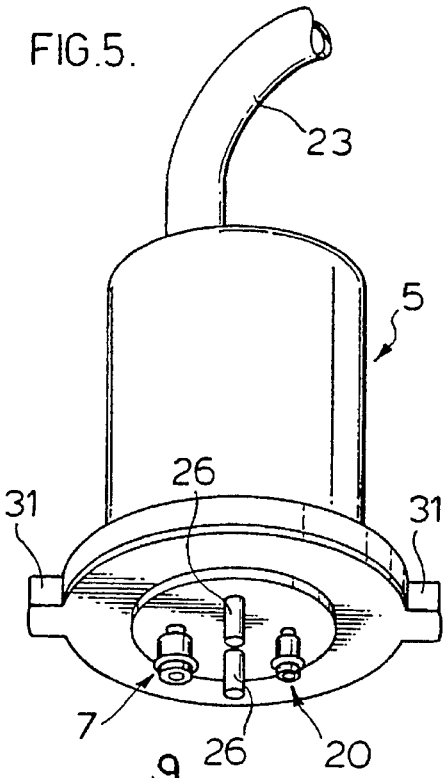
FIG. 5 is a perspective view of the connector of FIG. 1.

As seen most clearly in FIG. 2, the top of the cap 11 has a substantially circular aperture 24 for receiving the spigots 7 and 20 of the connector 5. The diameter of the aperture 24 is slightly greater than the distance between the outer edges of the undercuts 22, 22' of the spigots. On opposite sides of the aperture 24 there are enlarged portions 25' which allow the spigots 7, 20 to be inserted into the passages 4 and 16 of the plug. The steps 15, 17 of the passages may be relied on to limit the extent to which the spigot can be inserted.

In this first position where the spigots are aligned with the enlarged areas 25' the inlet 32 of passage 4 does not register with the outlet 2 in the closure member. Rotation of the plug 3, by means of the connector 5, through 90° , for example, brings the passage 4 into registration with the inlet 2, thus allowing the product to be emptied out of the container. Rotation of the connector 5 and thereby the plug 3 is limited by the radial lugs 31 abutting up against the upstands 30 on the cap 11. Such cooperating devices on the connector and cap define the open position for the plug.

It will be appreciated that in this second position, the undercuts 22, 22' of the spigots engage the edge of the aperture 24 of the cap 11, so that the connector 5 cannot be removed. The connector can only be removed by rotating it back to the first position where the spigots are aligned with the enlarged areas 25'. In this position the inlet 2 is closed and if required, the connector can be pulled away from the plug to disconnect the connector. The contents of the drum cannot therefore be accidentally emptied out by leaving the closure in the wrong position after removal of the connector.

Another safety measure which prevents the contents of the drum being filled into the wrong containers is provided by means of identification keys and recesses. In the illustrated embodiment, the keys are on the connector 5 and the recesses are on the plug 3, but this is not essential.

The keys are formed by a pair of spaced-apart pins 26, which may for example be cylindrical in shape, on the face of the connector 5 which abuts the cap Correspondingly shaped recesses 27 are provided in the plug 3. Drums containing different products will have the recesses in different positions and connectors for different products have lugs in different positions. In FIG. 2, alternative positions of the recesses are shown in dotted lines. This means that only a connector designed for a specific drum can be connected to that drum, thus preventing incorrect filling of containers.

A system of two pins and six recesses give fifteen different permutations for connections to be made. If desired the connectors and caps can also be color-coded to aid users selecting the correct connectors and drums.

The spigot 7 for the product has a non-return valve 28 which prevents product escaping from the suction tube when the connector is removed from the drum. Similarly, the passage for air through the connector 5 has a non-return valve 19, to prevent evaporation from the drum.

It is apparent from a discussion of the components for the drum closure that assembly can be made in a convenient safe manner. As can be appreciated, the drum may be shipped with the closure member secured to the drum by cap 11. The user then need only couple the corresponding connector 5 to the closure member to complete the closure for dispensing of liquids from the container. Alternatively, one can assemble the closure on sight. The normal drum cap may be removed and the closure member inserted in the drum where the flange 36 prevents the closure member from dropping to within the drum. The seal 13 may remain on the drum opening neck. The plug 3 is then placed in the closure member 1 and this part of the assembly completed by screwing on the cap 11 which includes an opening 24 to allow access to the exposed portion 42 of the plug. The connector 5 may then be connected to the plug to complete assembly and when desired rotated 90° to align the connections. Hence when the connections are both closed, the drum is sealed. However, when rotated, the product inlet and air inlet connections are made to permit dispensing of liquid from within the drum. It is also appreciated that the pins 26, which are used as part of a key-way system to ensure that the correct connector 5 is coupled to the drum containing the desired liquid, are also useful for engaging the recesses 27 to transmit torque from the connector 5 to the plug 3. The pins 26 therefore, in transmitting the torque to the plug, avoid bending of the spigots 7 and 20 which may be more fragile than pins 26. The tendency to snap off the spigots 7 and 20 could be a problem by virtue of the undercuts 22 and 22' provided in the spigot shafts.

Figure 6:
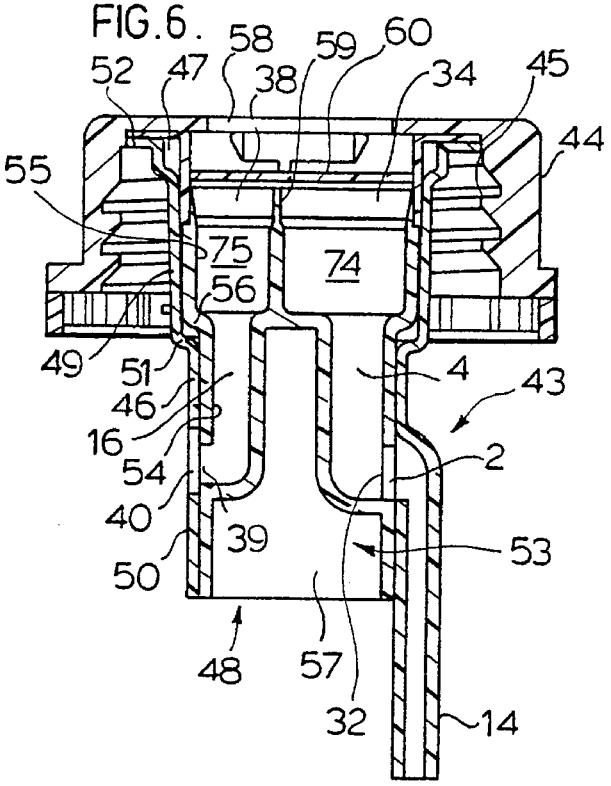
FIG. 6 is a section through an alternative embodiment of the closure member.
Figure 7:
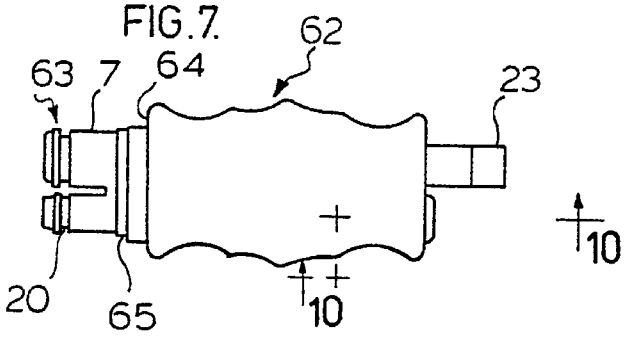
FIG. 7 is a plan view of the connector for engagement with the closure member of FIG. 6.

An alternative embodiment for the closure is shown in FIGS. 6 and 7. The closure 43 has a cap 44 with threaded interior 45. The threads 45 engage corresponding threads on the neck of a container opening. The closure member 46 is in the shape of a sleeve having an open upper end 47 and an open lower end 48. The sleeve has two stepped cylindrical portions 49 and 50 with indent 51. At the open outer end of the closure member 46 is a peripheral flange 52 which rests on the neck of the container in the same manner as the flange 36 is used in the embodiment of FIG. 3. A plug 53 is inserted in the closure member 46. The plug 53 has mating corresponding cylindrical portions 54 and 55 which are stepped at 56 to match the configuration of the closure member. A reasonably snug friction fit is provided between the faces of the cylindrical portions 54, 55 with the closure member 49 and 50 to ensure that liquid does not pass between these two elements. The bottom 57 of the plug is open to facilitate molding of the component. The plug 53 has the normal through-passages as in the embodiment of FIG. 3 and in order for comparison, the same numbers have been used to describe the same aspects of the passages. The sleeve 46 has inlet 2 for the liquid which is drawn up through the tube 14. The passage 4 has inlet 32 and outlet 34. Correspondingly, the sleeve has air inlet 40 for the air and the passage 16 has outlet 39 and air inlet 38. The cap 44 has an opening 58 to allow access to the upper portion 59 of the plug 53. A seal 60 is provided across this exposed portion of the plug 59. In use that seal 60 may be removed before the connector 62 is connected to the closure 43. The seal 60 serves to protect the exposed end of the plug during shipping and the like. The seal may be a membrane which is readily punctured and/or removed, or may be an adhesive type membrane which has a tab and is peeled off to reveal the exposed end of the plug.

The exposed end of the plug is recessed relative to the opening 58 in the cap 44. Hence the spigot arrangement 63 extends downwardly relative to the bottom portion 64 of the connector 62. The spigots 7 and 20 are inserted in the corresponding sockets 74 and 75 of the plug 53. An undercut at 65 may be provided which interferes with the edge of the opening 58 in the manner described with respect to undercuts 22, 22' and edge of the aperture 24 of the cap 11 of FIGS. 1 and 2 to retain the connector 62 in place when the plug has its openings aligned with the openings in the sleeve. As with the embodiment of FIG. 1, the connector and/or the closure member may have appropriate stops (not shown) to define at least the open position.

Figure 8:
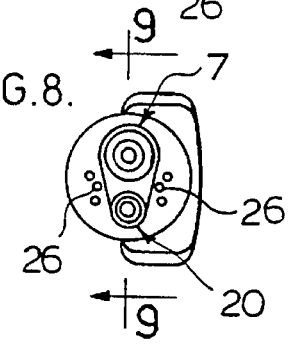
FIG. 8 is an end view of the connector of FIG. 7.
Figure 9:
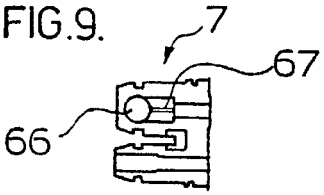
FIG. 9 is a section along the lines A—A of FIG. 8.
Figure 10:
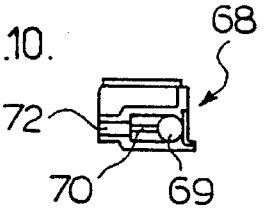
FIG. 10 is a section along the lines B—B of FIG. 7.

As shown in FIG. 8, in the end view, the respective spigots 7 and 20 are provided for purposes of passage of liquid and air through the respective passages 4 and 16. Also provided on the base of the connector 62 are the appropriate pins 26 which are used as key devices to ensure that the proper connector 5 is matched with the corresponding closure member 43. As shown in FIGS. 9 and 10, suitable one-way check valves are used with respect to passages 4 and 16. In FIG. 9, the check valve for the spigots and hence the one-way valve which controls the flow of liquid out of the drum is provided. The valve consists of a ball 66 which is spring-loaded at 67. As liquid is withdrawn from the container, the ball moves against the spring pressure to allow fluid to flow through the spigot. Correspondingly, the check valve 68, as shown in FIG. 10, is provided for the air through-passage. As air is drawn into the system, the ball 69 moves against the spring pressure 70 to allow air to move into the passage 72 which is in communication with the corresponding spigot 20 of the connector 62. Also with the connector 62 in the usual manner, a hose, such as hose 23, is connected to the through-passage which is in communication with the spigot 7 in order to deliver the withdrawn liquid to the desired use position.

The closures, according to the invention, provide for a quick, secure and safe connection and release of a suction tube to a drum. The more complex and therefore expensive parts, for example the product and air valves, are provided in the reusable connector, rather than the returnable drum. In addition, any elastomeric components are in the connector, not the drum. This reduces the risk of chemical attack, increases the range of chemicals which can be used and benefits recycling. Furthermore, recycling of the drum is aided since there are no dissimilar materials to be separated. The other parts of the connector and drum are molded from polypropylene or polyethylene.

Other advantages and features of the system include product identification by 15 or more possible codes, such as provided by the pin key system. Since the materials are from polypropylene and/or polyethylene, such plastomers may be colored to provide color coding for the connector and the closure member. The use of a connector separate from a closure provides for a quick connect/disconnect with automatic closing of the connector and closure member when the two units are pulled apart. The closure of the connector is provided by virtue of the one-way check valves in the spigots 7 and 20. Furthermore, with the air vent system for the drum, solvent evaporation and spillage is avoided. When the closure is in the closed position, air cannot move into or out of the drum. This feature is always assured because the plug must be in the closed position in order to permit removal of the connector from the closure device. Another advantage of the closure with the plug in the hollow closure member is that there is no significant volume of liquid retained in the closure member when the connector is removed.

Although preferred embodiments of the invention are described herein in detail, it will be understood by those skilled in the art that variations may be made thereto without departing from the spirit of the invention or the scope of the appended claims.

We claim:

1. A closure for allowing the emptying of the contents of a container, the closure having:

a hollow closure member for a container, the closure member having an outlet for the contents;

a rotatable plug mounted within the closure member, the plug having a first through-passage for the contents with an inlet and an outlet, said plug being rotatable between a first closed position in which said inlet of the through-passage is out of register with the closure member outlet and a second open position in which said inlet is in register with the closure member outlet to permit the contents to pass into the passageway;

means for retaining said closure member in a container;

a connector for transfer of the contents out of the container, the connector having means to engage an exposed portion of the plug, the connector having a second through-passage with an inlet in communication with said outlet of said first through-passage of said plug;

said closure being characterized in that a means is provided for sealing said plug with said closure member, where, when engaged, said plug retains an airtight seal when in register with said closure member;

said retaining means retaining said rotatable plug within said closure member, said retaining means exposing an outer portion of said rotatable plug, said exposed portion having said outlet of said first through-passage therein, and means for sealing said second through-passage with said outlet of said first through-passage where said connector is able to engage said plug in one motion, without losing an airtight seal;

the connector when engaged with the plug, can be turned to rotate said plug to said open position or to said closed position, wherein said selating means for said connector retains said seal between said plug and said connector in said open position.

2. A closure according to claim 1, wherein the plug has a third through-passage for air with an inlet and an outlet, said inlet of the third through-passage being in said exposed portion of said plug and spaced-apart from said outlet of said first through-passage, the closure member has an inlet for introducing air into a container with which the outlet of the third through-passage registers on rotation of the plug to said open position.

3. A closure according to claim 2, wherein said connector has a fourth through-passage with an inlet and an outlet, said outlet of said fourth through-passage being in communication with said inlet of said third through-passage when said connector is engaged with said plug exposed portion.

4. The closure according to claim 2, wherein the plug and connector have respective identification keys or recesses.

5. A closure according to claim 3, wherein said first and second through-passages and said third and fourth through-passages are interconnectd to communicate with one another by a spigot and socket coupling.

6. A closure according to claim 3, wherein a first one way check valve is provided in said second through-passage to provide one-way flow from said first through-passage through said second through-passage and a second one-way check valve is provided in said fourth through-passage to provide one-way flow from said fourth through-passage through said third through-passage.

7. A closure according to claim 3, wherein a pair of identification keys is provided on the connector, for engagement with a corresponding pair of recesses in the plug.

8. A closure according to claim 1, wherein said retaining means is for a container opening, said cap having an open top to provide access to said exposed portion of said plug.

9. A closure according to claim 8, wherein said hollow closure member has an open outer end into which said plug is inserted, said closure member having a circular peripheral flange adjacent said open outer end, said cap securing said closure member in a container opening by clamping said flange against such container opening.

10. A closure according to claim 8 wherein said connector and said cap have cooperating means which stop rotation of said plug at said open position.

11. A closure according to claim 8 wherein a tear-off membrane seal is provided on said exposed portion, said cap being removed to permit removal of said membrane seal, said connector engaging said plug with said cap in place on the container.

12. A closure according to claim 1, wherein said hollow closure member has an open outer end and an open inner end to provide a sleeve for mounting in a container opening, said sleeve having said outlet of said closure member, said plug when placed in said sleeve closing said open outer end from container contents.

13. A closure according to claim 1, wherein said means for engaging said exposed portion of said plug comprises pins projecting from said connector which are received by recesses in said exposed portion, said pins engaging said recesses to turn said plug as said connector is turned.

14. A closure according to claim 1, wherein the plug and connector have respective identification keys or recesses.

15. A closure according to claim 1 wherein means is provided for covering said exposed portion of said plug, said covering means being removable to permit engagement of said connector with said plug exposed portion.

* * * * *